US005148955A

United States Patent [19]

Cares

[11] Patent Number: 5,148,955

[45] Date of Patent: Sep. 22, 1992

[54] SHIELDED INFLATABLE SIDE BAGS FOR SHIRT PRESSER BAG ASSEMBLY

[75] Inventor: George Cares, Grand Rapids, Mich.

[73] Assignee: Sheldon Company, Kentwood, Mich.

[21] Appl. No.: 716,008

[22] Filed: Jun. 17, 1991

[51] Int. Cl.[5] ..... D06C 15/00; D06F 71/14

[52] U.S. Cl. ..... 223/70; 38/14; 223/67

[58] Field of Search ..... 38/1 R, 1 A, 12, 14; 223/57, 67, 70, 72, 73, 74

[56] References Cited

U.S. PATENT DOCUMENTS

| | | | |
|---|---|---|---|
| 2,743,853 | 5/1956 | McLagan | 223/57 |
| 2,743,854 | 5/1956 | Strike | 223/57 |
| 2,854,177 | 9/1958 | Strike et al. | 223/57 |
| 2,948,444 | 8/1960 | Paris | 223/70 X |
| 3,008,613 | 11/1961 | Paris | 223/57 X |
| 3,084,838 | 4/1963 | Pearson et al. | 223/57 X |
| 3,165,244 | 1/1965 | Dorsal | 223/67 |
| 3,384,347 | 5/1968 | Lornitzo | 223/57 |
| 3,464,602 | 9/1969 | Romansky | 223/57 |
| 3,471,067 | 10/1969 | Stewart | 223/57 |
| 3,480,187 | 11/1969 | Bonn | 223/67 |
| 3,482,745 | 12/1969 | Forman | 223/67 |
| 3,568,900 | 3/1971 | Paris | 223/70 |
| 3,595,450 | 7/1971 | Schlemon et al. | 223/57 |
| 3,613,969 | 10/1971 | Forse | 223/57 |
| 4,843,745 | 7/1989 | Oberley | 38/34 |
| 4,890,401 | 1/1990 | Weisfeld | 38/43 |

FOREIGN PATENT DOCUMENTS

| | | | |
|---|---|---|---|
| 1194000 | 6/1970 | United Kingdom | 38/14 |

*Primary Examiner*—Werner H. Schroeder
*Assistant Examiner*—Ismael Izaguirre
*Attorney, Agent, or Firm*—Price, Heneveld, Cooper, DeWitt & Litton

[57] ABSTRACT

A shield for the inflatable side bags of both shirt and sleeve presser bag assemblies to substantially prevent the folding or pinching of the inflatable side bags during pressing. The shields are preferably fabricated from the same material as the body bag which is stiffer and less prone to folding than the side bag material. Folding and pinching of the inflatable side bags can be prevented when the shields extend to the point just past the point of maximum ballooning of the inflatable side bags.

20 Claims, 3 Drawing Sheets

SHIELDED INFLATABLE SIDE BAGS FOR SHIRT PRESSER BAG ASSEMBLY

BACKGROUND OF THE INVENTION

The present invention relates to shirt presser machines and, more particularly, to the body bags used on shirt presser machines to balloon and press the shirts with steam.

Various equipment has been developed for automatically pressing shirts and similar garments in order to reduce the amount of time and labor required in the cleaning process of a laundry, or the like. The typical shirt-pressing equipment comprises a relatively thin upright buck draped with an integrally formed bag structure having inflatable sides and top portions, and heated pressing plates which are engageable with the front and rear surfaces of the buck to press the front and rear portions of a shirt draped over the buck. The inflatable portions of the bag inflate to fill out the side edges of the shirt and collar or yoke portion of the shirt since the presser plates are usually not effective in these regions. Moreover, the inflating features of the assembly allows the inflatable portions of the bag assembly to assume the shape of the shirt, regardless of the particular shape of the shirt, so that tapered or flared waist portions, or wide or narrow shoulder portions can be accommodated and effectively pressed along with the front and back portions of the shirt in a single process. Similar equipment has been developed for automatically pressing the sleeves of shirts and similar garments.

The bag structure placed over the upright buck has typically comprised a body portion or bag fabricated of a heat-resistant, soft porous material, with inflatable side portions, or bags, and an inflatable top portion, or yoke, connected to the side edges and top edge of the body portion. The side portions and top portion of the bag assembly are fabricated of a less porous, slick material which is suitable for inflation by hot air and which allows most shirt fabrics to slide smoothly over the outside surfaces of these portions of the bag assembly without inhibiting the adjustment and arrangement of a typical shirt when placed upon the bag assembly and buck. The bag structure for the buck used for pressing sleeves is of similar construction.

In the function of the shirt-pressing equipment, the body portion of the bag assembly is not inflated and merely acts as a buck cover or as an internal surface against which the shirt is pressed by the heated plates. The inflatable side bags and yoke are inflated during each operation of the shirt-pressing machine. This continual flexing, stretching and abrasion by the inflatable portions of the bag assembly together with the friction between these portions of the bag assembly and the garments placed over the assembly cause the inflatable portions of the bag assembly to wear more rapidly than the body portion. In addition, the inflatable side bags tend to fold over and become pinched by the pressing plates during operation. This folding and pinching accelerates the wearing of the inflatable side bags even more.

The folding and pinching is often due to the manner in which a shirt is placed over the shirt presser bag and its presser buck. The shirt is usually pulled down fairly tight over the body portion of the bag by the operator and pulled into a smooth configuration so that the presser plates will not form wrinkles during the pressing function. When draping and smoothing a shirt over the assembly, the operator usually pulls with enough force on the shirt to collapse and substantially close the inflatable side portions of the bag assembly. When air is subsequently fed to the inflatable side portions, the binding of the inflatable side portions by the shirt is occasionally such that the inflatable side portions are not able to expand properly, and do not properly inflate. This not only inhibits the proper wrinkle-removing function of the inflatable portion of the bag assembly, but it also sometimes causes a portion of the inflatable side portions of the bag assembly to fold over and become pinched between the body portion of the bag assembly and the heated plates of the shirt-pressing equipment during pressing of the shirt. Similar folding and pinching occurs to the inflatable side bags of the sleeve bag assembly.

When any one of the side portions of the bag assembly becomes worn or damaged so that it does not properly inflate to perform the desired expanding and pressing function, the entire bag assembly must be removed from the buck and discarded, even though the body portion and the other inflatable side portion may have several weeks' or months' wear left.

SUMMARY OF THE INVENTION

The present invention provides for a shield for the inflatable side bags of both shirt and sleeve presser bag assemblies. A presser bag assembly consists of a body bag to which inflatable side bags are attached. The present invention provides for the attachment of fabric shields for the side bags to substantially prevent the folding or pinching of the inflatable side bags during pressing. The shields are fabricated from a second material which is stiffer and less prone to folding than the side bag material, preferably from the same material as the body bag. For example, the shields may be formed by attaching an additional, slightly larger, piece of body bag material to the body bag so that portions of the body bag material extend beyond the point of attachment between the body bag and the inflatable side bags. This extension of body bag material acts as the shield.

In another embodiment, the shields may be formed by using a slightly larger original piece of body bag material during manufacturing and attaching the inflatable side bags to the body bag in such a fashion whereby a portion of the original body bag fabric extends beyond the point of attachment between the body bag and the inflatable side bags to overlap the inflatable side bags. While a variety of shield lengths may assist in preventing the folding and pinching of the inflatable side bags, best results are obtained when the shield extends to the point just past the point of maximum ballooning of the inflatable side bags.

These and other objects, advantages and features of this invention will become apparent upon review of the following specification in conjunction with the drawings.

A BRIEF DESCRIPTION OF THE DRAWINGS

DETAILED DESCRIPTION OF THE PREFERRED EMBODIMENTS

Figure 1:
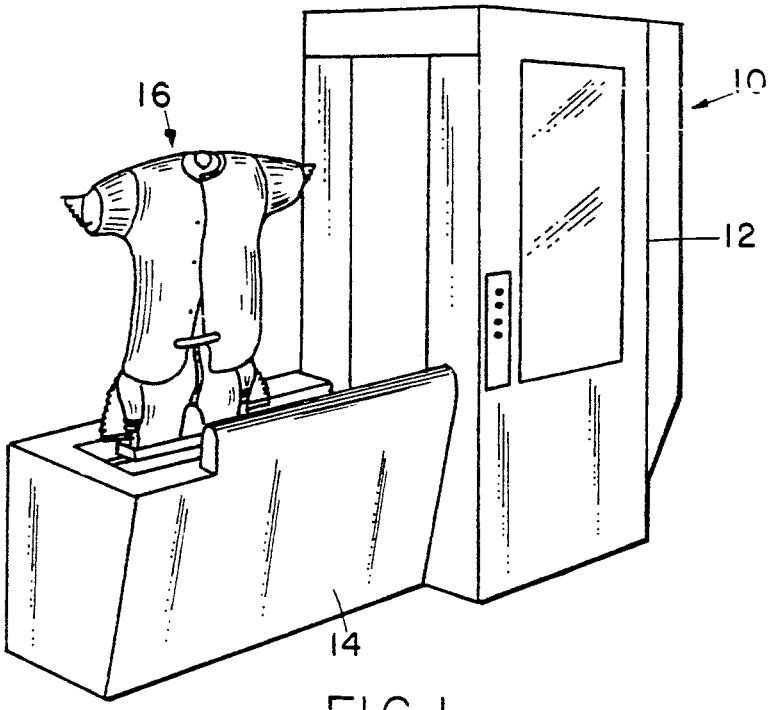
FIG. 1 is a perspective view of a shirt presser showing a shirt positioned on a moveable shirt presser bag assembly.
Figure 10:
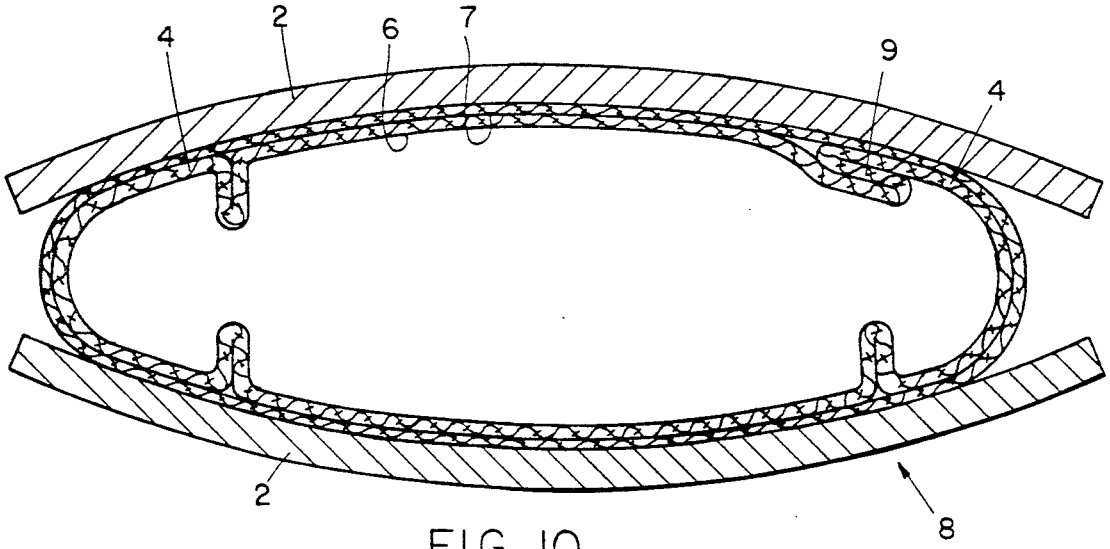
FIG 10 PRIOR ART
FIG. 10 is a sectional view of a pair of heated plates of a shirt presser pressing a shirt against a prior art shirt presser bag assembly.

Referring now to the drawings and the embodiments illustrated therein, in which like numerals indicate like parts throughout the several views, FIG. 1 shows a shirt presser 10 and includes a pressing cabinet 12 and an extension 14. An upright, relatively thin and wide buck 16 is movable from extension 14 into and out of pressing cabinet 12. As related in U.S. Pat. No. 3,595,450, which is incorporated herein by reference, the operator drapes a shirt or similar garment over buck 16 and closes a switch which functions to move the buck within pressing cabinet 12 where a pair of heated plates 2 engage the front and back surfaces, of the shirt and press the shirt against the buck (FIG. 10). This functions to "press" or remove the wrinkles from the shirt in its front and back portions. The sleeves of the shirt are usually pressed by another piece of similar equipment (FIG. 8) before the shirt presser is used.

Figure 11:
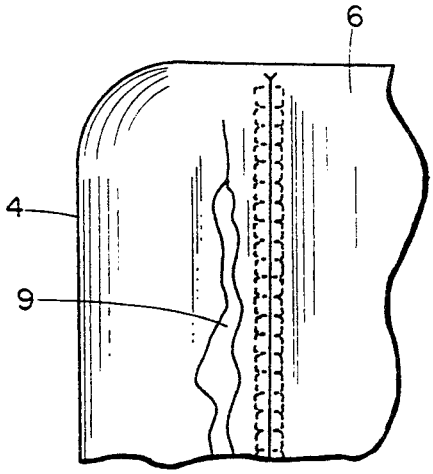
FIG 11 PRIOR ART
FIG. 11 is a sectional view of a prior art shirt presser bag assembly showing a worn out folded side bag.

A prior art shirt presser bag assembly 8 is shown in FIG. 10. As indicated above, sometimes the shirt to be pressed is pulled down so tightly over the body bag 6 of shirt presser bag assembly 8 that the inflatable side bags 4 are substantially closed. When air is subsequently fed to the inflatable side bag 4, the binding of the inflatable side bags 4 by the shirt is occasionally such that the inflatable side bags 4 are not able to expand and inflate properly. This sometimes causes a portion of the inflatable side bag 4 to fold over and become pinched between the body bag 6 of bag assembly 8 and the heated plate 2 of the shirt pressing equipment to form a seam 9. Continued pinching of side bag 4 causes the bag 4 to become prematurely worn or damaged at seam 9 (FIG. 11). When that occurs, the entire bag assembly 8 must then be removed from the buck and discarded.

Figure 2:
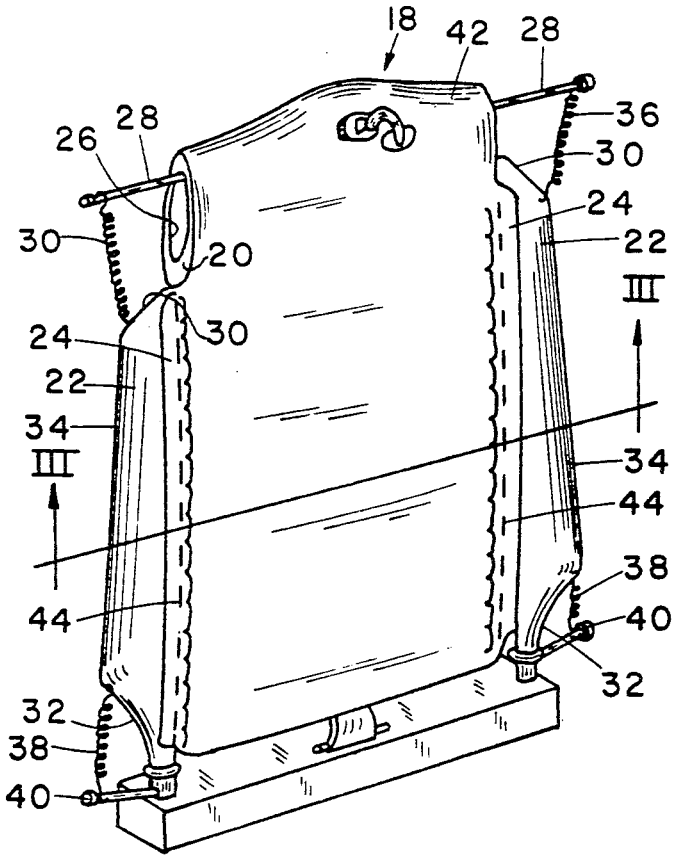
FIG. 2 is a perspective view of a first embodiment of the moveable shirt presser bag assembly according to the present invention.

As is shown in FIG. 2, shirt presser bag assembly 18 is placed over the buck 16. Shirt presser bag assembly 18 includes a body bag 20, side bags 22, and shields 24. Body bag 20 generally conforms in shape to buck 16 and usually includes a central vertical zipper (not shown) for closing and opening body bag 20 from buck 16. The construction of the zipper is such that a substantially smooth and flat surface is maintained in the front of body bag 20, so that no ridges or undesirable wrinkles will appear in a shirt or similar garment that is pressed on body bag 20. As shown in cross-section in FIGS. 3, 4, 5 ,6 and 7, shirt presser assembly 18 also includes alternative embodiments for shields 24 in the form of shields 24*a, b, c* and *d*. In these cross-sections, the structure and composition of buck 16, not being critical to the present invention, is not indicated in any detail.

Referring back to FIG. 2, armholes 26 are defined in the upper side edges of body bag 20, and the reciprocal tensioning rods 28 of the buck 16 are movable along their lengths through armholes 26. Side bags 22 are connected to the side edges of body bag 20. Side bags 22 are identical to each other. Their upper and lower ends 30 and 32 are tapered downwardly and upwardly, respectively, and each have an outer edge 34. Springs 36 and 38 are connected to the upper and lower ends of the outer edge 34 to pull outer edge 34 generally away from body bag 20. Upper spring 36 of each side bag 22 is connected to reciprocal rod 28 while lower spring 38 is connected to pivotal rod 40 of the shirt presser mechanism.

Figure 3:
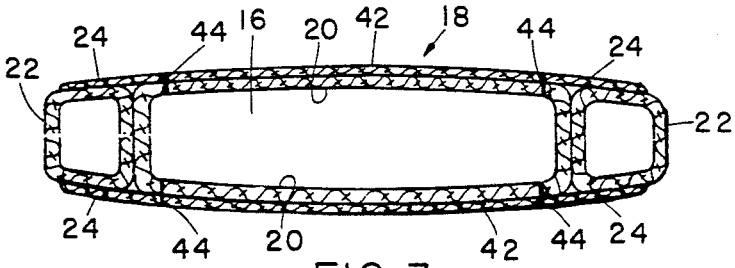
FIG. 3 is a sectional view taken along the lines III—III in FIG. 2.

Shields 24, as shown in FIG. 2, are the ends of fabric layer 42 which covers a first side of body bag 20 and portions of a second side of inflatable side bags 22. A stitching line 44 in FIGS. 2 and 3 indicates the point of demarcation between body bag 20 and inflatable side bag 22. As shown in FIG. 3, the ends of a second fabric layer 42 also cover a second side of body bag 20 and portions of a second side of inflatable side bags 22 with shields 24.

Figure 4:
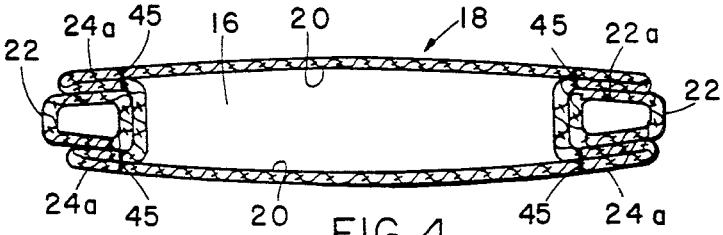
FIG. 4 is the same view as FIG. 3 of a second embodiment of the moveable shirt presser bag assembly of the present invention.
Figure 5:
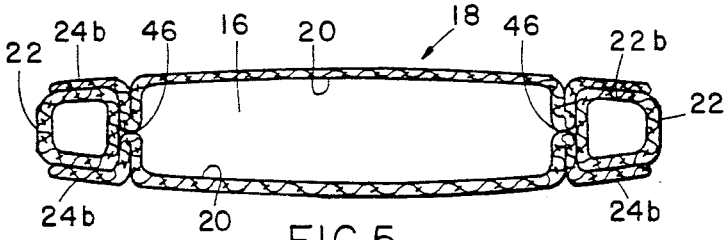
FIG. 5 is the same view as FIG. 3 of a third embodiment of the moveable shirt presser bag assembly of the present invention.

As shown in FIGS. 4 and 5, shields 24 also may be fabricated from an extension of the fabric of body bag 20. With reference to FIG. 4, prior to attachment of side bags 22, fabric layers 42 are first extended beyond the proposed point of attachment of side bags 22 to body bag 20. These extensions are then folded back on themselves and run back to the body bag to which they are attached. Shields 24*a* are thus formed. Stitching lines 45 indicate a point at which these extensions may be stitched to enhance the performance of the shields 24*a*. Side bags 22 are then attached to body bag 20 between shields 24*a*.

FIG. 5 illustrates another embodiment for fabrication of shields 24. Prior to attachment of side bags 22, fabric layers 42 are first folded over and attached to body bag 20 at stiching point 46. The layers are then folded back over themselves and projected outwards in a shape similar to a "C". Side bags 22 are then attached to body bag 20 between formed shields 24*b*.

Figure 6:
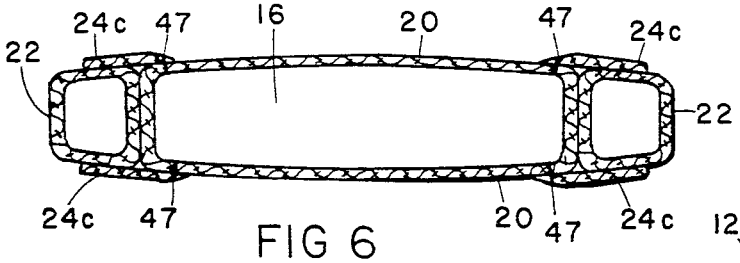
FIG. 6 is the same view as FIG. 3 of a fourth embodiment of the moveable shirt presser bag assembly of the present invention.

FIG. 6 illustrates another embodiment for fabrication of shields 24. Prior to or following attachment of side bags 22, individual shields 24*c* made of fabric 42 are attached to body bag 20 at stitch points 47.

Figure 7:
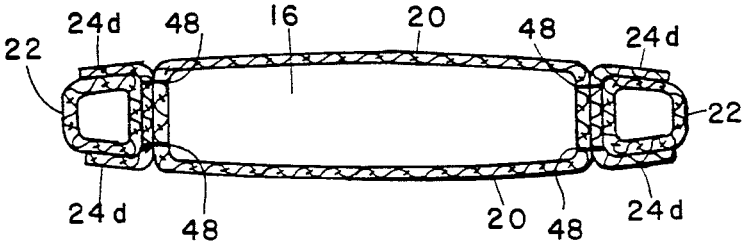
FIG. 7 is the same view as FIG. 3 of a fifth embodiment of the moveable shirt presser bag assembly of the present invention.

FIG. 7 illustrates another embodiment for fabrication of shields 24. Prior to attachment of side bags 22, a layer of fabric 42, preferably in a C-shaped design, is attached to body bag 20 at stitching points 48. Shields 24*d* are thus formed. Side bags 22 are then attached to body bag 20 between shields 24*d*.

Side bags 22 are fabricated of a smooth material usually of a porous weave which allows some flow of air through the bags and into the shirt or garment placed over the bag during the pressing function, but does not allow substantial airflow to the atmosphere. Fabric layer 42 and body bag 20 are fabricated of a porous, non-inflating material which is rougher and stiffer than the smooth material of side bags 22. An example of such a porous, non-inflating material is marketed under the trademark BONTEX for use on the Ajax CBS-C bag assembly produced by the F.H. Bonn Company, Arlington Heights, Ill.

Without wishing to be bound to any particular explanation as to the mechanism by which the present invention successfully operates, the inventor believes that the stiffer fabric of the shields 24, 24*a*, 24*b*, 24*c* and 24*d*, which are formed from the BONTEX material of fabric layer 42 or from body bag 20, substantially prevents the folding and pinching of the less stiff material of inflatable side bags 22 between the body bag 20 and the heated plates of the shirt-pressing equipment during pressing of the shirt.

In operation, the operator dresses pressing buck 16 and its shirt presser bag assembly 18 with a shirt 70 which is to be pressed. The operator then causes air to flow into inflatable bags 22 to cause the bags to assume the shape of the side edges of the shirt. Shields 24, 24*a*, 24*b*, 24*c* or 24*d*, depending upon the embodiment being utilized, substantially prevent any folding over and pinching of the inflatable bags 22 which could be caused from the constriction of the shirt 70. Presser buck 16 is then moved into pressing cabinet 12 and the heated pressing plates (not shown) of pressing cabinet 12 move into engagement with the front and back surfaces of shirt 70 and press shirt 70 against shirt presser bag assembly 18 and pressing buck 16. This functions to remove the wrinkles from shirt 70. After a predetermined time period, the heated presser plates will be moved away from shirt 70 and presser buck 16 and shirt 70 will be removed.

As previously stated, side bags 22 are fabricated of a smooth material to assist the operator in placing shirts over the shirt presser bag assembly 18. Frequently, the operator pulls the shirt on the bag assembly 18 with enough force to collapse and substantially close the inflatable side portions of the bag assembly. Because they are stiffer than the material used for the inflatable side bags 22, the shields 24, 24*a*, 24*b*, 24*c* and 24*d* do not fold over as easily as the side bags 22. The shields, therefore, substantially prevent the folding over of the inflatable side bags 22 onto the buck 16 which substantially prevents their being caught and pinched by the press which allows them the opportunity to properly inflate. While a variety of shield lengths may assist in preventing this folding and pinching, it has been discovered that use of a shield to the point just past points 22*a* and 22*b* of maximum ballooning of the side bags achieves the maximum protection against folding and pinching of the side bags.

Figure 8:
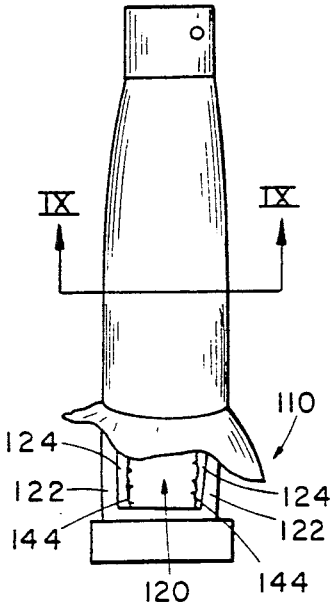
FIG. 8 is a side elevation view of a sleeve presser showing a sleeve positioned on a moveable sleeve presser bag assembly.
Figure 9:
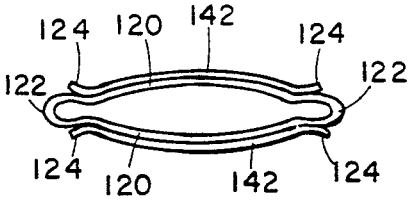
FIG. 9 is a sectional view taken along the lines IX—IX in FIG. 8.

As is shown in FIG. 8, and in cross-section in FIG. 9, the presser bag assembly of the present invention also can be used for substantially preventing the same folding and pinching problems which occur with sleeve pressing equipment, a sleever arm 110 of that sleeve pressing equipment being shown, although in a proportionally smaller form. Inflatable side bags 122 and shields 124 are identical to each other and stitching line 144 indicates the point of demarcation between body bag 120 and side bags 122.

As with the shirt presser bag assembly 18, shields 124 can be extensions of the material used to fabricate body bag 120 or can be extensions of fabric layer 142. The alternative embodiments contemplated for the shields used with the shirt presser are also useful for the sleeve presser. Regardless of design, the extension of the stiffer shield material substantially prevents the inflatable side bags from folding over and becoming pinched between the body bag 120 and the heated plates (not shown) of the sleeve-pressing equipment 110 during pressing of the sleeves. This results even when the operator pulls with enough force on the sleeves to collapse and substantially close the inflatable side portions of the bag assembly. The shields 124 allow the side bags 122 to properly inflate. Again, while a variety of shield lengths may assist in preventing this folding and pinching, it has been discovered that use of a shield to the point just past the point of maximum ballooning of side bags 122 achieves the maximum protection against folding and pinching of the side bags.

The foregoing detailed description is given for clearness of understanding only, and no unnecessary limitations should be implied. Various modifications to the preferred embodiments described herein can be made by those skilled in the art without departing from the spirit or scope of the invention as defined by the appended claims.

The embodiments of the invention in which an exclusive property or privilege are claimed are defined as follows:

1. A presser bag assembly for use with a presser machine having a buck with at least one pressing surface and a heated plate for selective juxtapositions with said at least one pressing surface of said buck, said presser bag assembly being positioned over said buck and comprising:

(a) a body bag;

(b) at least one inflatable side bag made of a first material and extending laterally from said body bag; and (c) a shield fabricated from a second material that is stiffer than said first material and extends laterally over a portion of said inflatable side bag in an effective amount to substantially prevent folding and pinching of the inflatable side bag against the body bag during pressing.

2. The presser bag assembly in accordance with claim 1, wherein said inflatable side bag has a point of maximum ballooning and said shield extends just past the point of maximum ballooning.

3. The presser bag assembly in accordance with claim 2, wherein said shield is fabricated from a porous material.

4. The presser bag assembly in accordance with claim 1, wherein said shield is formed as an extension of the body bag material.

5. The presser bag assembly in accordance with claim 4, wherein said inflatable side bag has a point of maximum ballooning and said shield extends just past the point of maximum ballooning.

6. The presser bag assembly in accordance with claim 5, wherein said shield is fabricated from a porous material.

7. The presser bag assembly in accordance with claim 1, wherein said shield is formed as a fabric layer attached to said body bag.

8. The presser bag assembly in accordance with claim 7, wherein said inflatable side bag has a point of maximum ballooning and said shield extends just past the point of maximum ballooning.

9. The presser bag assembly in accordance with claim 8, wherein said shield is fabricated from a porous material.

10. A presser bag assembly comprising:

(a) a body bag having two sides;

(b) a pair of inflatable side bags attached to each side of said body bag; and (c) a pair of inflatable side bag shields, said shields being fabricated from a stiffer material than a material of the inflatable side bags and extending over said inflatable side bags in an effective amount to substantially prevent folding and pinching of the inflatable side bags against the body bag during pressing.

11. A presser bag assembly in accordance with claim 10, wherein said inflatable side bags have a point of maximum ballooning and said shields extend just past the point of maximum ballooning.

12. A presser bag assembly in accordance with claim 11, wherein said shields are fabricated from a porous material.

13. A presser bag assembly in accordance with claim 10, wherein said shields are formed from extensions of the body bag material.

14. A presser bag assembly in accordance with claim 13, wherein said inflatable side bags have a point of maximum ballooning and said shields extend just past the point of maximum ballooning.

15. A presser bag assembly in accordance with claim 14, wherein said shields are fabricated from a porous material.

16. A presser bag assembly in accordance with claim 10, wherein said shields are formed from a fabric layer attached to said body bag.

17. A presser bag assembly in accordance with claim 16, wherein said inflatable side bags have a point of maximum ballooning and said shields extend just past the point of maximum ballooning.

18. A presser bag assembly in accordance with claim 17, wherein said shields are fabricated from a porous material.

19. A method of manufacturing a shielded inflatable side bag for a presser bag assembly comprising:

(a) providing a body bag having a first side and a second side;

(b) supplying a first inflatable side bag and a second inflatable side bag;

(c) attaching said first and second inflatable side bags to said respective first and second sides of said body bag to form a presser bag assembly; and (d) covering said presser bag assembly with an additional layer of body bag material, whereby said additional layer of material extends just beyond the point of attachment of said inflatable side bags to said body bag.

20. A method of manufacturing a shielded inflatable side bag for a presser bag assembly in accordance with claim 19, wherein said body bag material is a porous material.

* * * * *